US005675991A

United States Patent [19]

Shelton et al.

[11] Patent Number: 5,675,991

[45] Date of Patent: Oct. 14, 1997

[54] CLEANING SYSTEM FOR KNITTING MACHINES

[75] Inventors: William Ewart Alan Shelton; Mark Alan Shelton, both of Croft, England

[73] Assignee: Alan Shelton Limited, United Kingdom

[21] Appl. No.: 624,432

[22] PCT Filed: Sep. 30, 1994

[86] PCT No.: PCT/GB94/02131

§ 371 Date: Jun. 3, 1996

§ 102(e) Date: Jun. 3, 1996

[87] PCT Pub. No.: WO95/09259

PCT Pub. Date: Apr. 6, 1995

[30] Foreign Application Priority Data

Sep. 30, 1993 [GB] United Kingdom ..... 932021.8
Nov. 18, 1993 [GB] United Kingdom ..... 9323743.6

[51] Int. Cl.[6] ..... D04B 35/32

[52] U.S. Cl. ..... 66/168; 15/301

[58] Field of Search ..... 66/168; 134/21; 15/301, 319

[56] References Cited

U.S. PATENT DOCUMENTS

| | | | |
|---|---|---|---|
| 3,459,010 | 8/1969 | Ferri | 66/168 |
| 3,535,895 | 10/1970 | Krauss | 66/168 |
| 5,373,711 | 12/1994 | Takemoto et al. | 66/168 |
| 5,379,614 | 1/1995 | Igarashi | 66/168 |
| 5,437,732 | 8/1995 | Igarashi et al. | 66/168 X |
| 5,497,531 | 3/1996 | Kuhrau et al. | 66/168 X |
| 5,557,949 | 9/1996 | Mori et al. | 66/168 |

FOREIGN PATENT DOCUMENTS

| | | | |
|---|---|---|---|
| 620012 | 7/1962 | Belgium | 66/168 |
| 0510508 | 4/1992 | European Pat. Off. . | |
| 657965 | 5/1929 | France . | |
| 1635971 | 6/1971 | Germany . | |
| 489653 | 6/1970 | Switzerland . | |
| 527942 | 10/1972 | Switzerland . | |

*Primary Examiner*—John J. Calvert
*Attorney, Agent, or Firm*—Young & Basile, P.C.

[57] ABSTRACT

In a circular knitting machine, a series of nozzles are positioned closely adjacent to points at which the knitting takes place. A fan unit draws air in through the nozzles via ducting and thereby creates a localized suction effect at the knitting points. The air is then passed to a duct which extends over the top of the knitting machine proper, and is emitted through a series of peripheral ducts in a downward direction and towards feed devices which feed yarn to the knitting points.

7 Claims, 1 Drawing Sheet

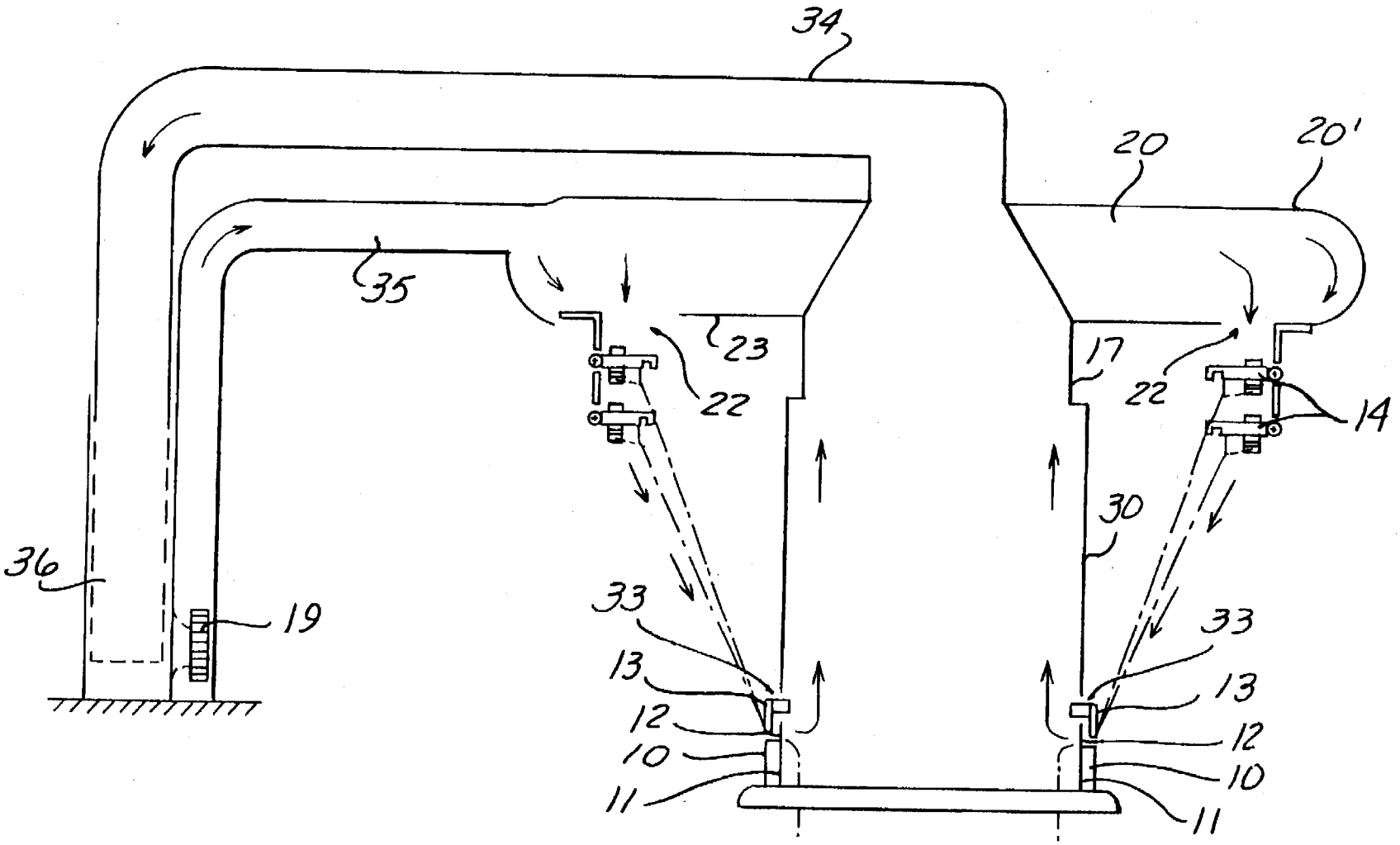
20'
14
20
22
17
30
33
13
12
10
11
34
23
22
33
13
12
10
11
35
19
36

CLEANING SYSTEM FOR KNITTING MACHINES

BACKGROUND OF THE INVENTION

This invention relates to a knitting machine having a cleaning system for removing lint.

The generation of lint when knitting cotton yarn occurs in two main areas: firstly, around wheels which feed the yarn to the machine (where there are many contact points at which fibers are released from the yarn), and secondly at the knitting points themselves (again due to contact between the yarn and the machine components, but also due to yarn-yarn contact during loop formation). It is undesirable that this lint should become deposited on sensitive mechanisms of the knitting machine. Accordingly, current practice is to mount fans on the machine which rotate or reciprocate in the appropriate areas.

Typically, axial fans are mounted to rotate/reciprocate in the center of the machine, on the one hand at the level where the feed wheels are mounted, and on the other hand inside the needle cylinder, blowing air outwardly through the needles, yarn feed points, etc. There are, however, drawbacks with this existing technology. Because the air around the machine is generally lint laden, blowing such air at parts required to be kept clean is not good practice. Inevitably, this lint laden air is entrained through the fans and therefore directed at the sensitive mechanisms. Moreover, many of the air streams created by these fans are at best horizontal (in the case of the needle cylinder fans, blowing radially outwards) and in many cases are pointed partially upwards. For this reason, lint which is removed is directed to float off into the surroundings, causing problems of contamination on adjacent machines, etc. In addition, the air flow over a given part of the machine is intermittent due to the rotation/reciprocation of the fan assemblies to cover all areas. Furthermore, these fan systems require "slip ring" electrical transmission boxes and multiple fans to reach the relevant areas, giving rise to maintenance problems.

As an alternative to this, cleaning can be performed by means of compressed air. Although this has the advantage that the air blown over the various parts of the machine is clean, compressed air systems are nevertheless rather expensive.

It is an object of the present invention to obviate or mitigate this problem.

SUMMARY OF THE INVENTION

According to the present invention, there is provided a knitting machine in which yarn is knitted at knitting points and is fed to the knitting points by feed devices, the knitting machine comprising at least one suction duct disposed at or closely adjacent to the knitting points, air circulation means operative to draw air in through the suction duct or ducts and thereby create a localized suction effect at the knitting points, duct means to which air is passed by the air circulation means and from which said air is emitted towards the yarn feed devices, and filter means through which the air passes in between being drawn in through the suction duct or ducts and being emitted from the duct means.

Desirably, the air is emitted from the duct means towards the yarn feed devices in a downward direction.

Conveniently, the air circulation means comprises a single fan unit which is connected to the suction duct or ducts by way of a duct or ducting.

Preferably, the air circulation means comprise a centrifugal fan unit.

Desirably, said at least one suction duct comprises an annular or arcuate duct which extends across the knitting points.

Advantageously, the air circulation means and the filter means are disposed remotely from the knitting machine.

Conveniently, the air circulation means and the filter means are positioned at or around ground level, and are connected to the suction duct or ducts by way of ducting which is of arched configuration.

BRIEF DESCRIPTION OF THE DRAWING

The invention will now be further described, by way of example only, with reference to the single FIGURE of the accompanying drawing, which is a schematic sectional side view of a knitting machine according to the present invention.

DETAILED DESCRIPTION OF THE PREFERRED EMBODIMENT

The illustrated knitting machine is of the circular type and contains a cylindrical bed 10 on which needles 11 are mounted for sliding movement in a conventional manner, for knitting yarn at knitting points 12. Yarn is supplied to the knitting points at feed points 13 by way of respective feed devices 14 which are mounted in a circular array around the upper part of the knitting machine.

A cylindrical chamber 30 is disposed centrally of the knitting machine and extends vertically downwardly from a manifold chamber 17. The chamber 30 terminates at a level just above that of the needles 12 and the feed points 13 and, at its lower end at least, the width of the chamber 30 corresponds approximately to that of the needle bed 10 and the ring of feed points 13. A generally annular or arcuate suction duct 33 is thus created at the bottom of the chamber 30 and adjacent to the needles 12 and the feed points 13. The side wall of the chamber 30 is preferably made of transparent material.

A centrifugal fan unit 19 is disposed remotely from the knitting machine and communicates with an upper end of the cylindrical chamber 30 by way of a duct 34 and the manifold chamber 17. The fan unit 19 also communicates by way of a further duct 35 with a chamber 20 which extends over the top of the knitting machine beneath a canopy $\mathbf{20^1}$ of the latter. At its periphery, the canopy $\mathbf{20^1}$ has a series of openings 22 which are directed substantially vertically towards the feed devices 14. A horizontal plate 23 seals the bottom of the chamber 20 from the remainder of the knitting machine.

In use, the fan unit 19 acts to draw air into the cylindrical chamber 30 through the suction duct 33, thereby creating a localized suction effect at the knitting points 12. Because it is possible to apply considerable suction forces in very close proximity to the lint sensitive areas of the needles 11 and the feed points 13, this is highly efficient in removing lint generated at the knitting points, and ensures that the lint is not blown over sensitive components of the machine. The air is then drawn up through the chamber 30 and thence through the manifold chamber 17 and the duct 34 to a filter bag 36 positioned at a lower end of the latter. The air is sucked through this bag immediately prior to passing through the fan unit 19 itself, and the bag removes entrained lint from the air stream. After passing through the fan unit 19, the air flows along the duct 35 and into the chamber 20, and is then emitted through the openings 22 to flow over the feed devices 14.

The outer periphery of the canopy 20[1] is configurated so as to turn the air stream inwardly as well as downwardly through the feed devices 14, and thence towards the suction area 33. Lint generated by contact of the yarn with the feed devices 14 is entrained in the air flow, which is then sucked into the chamber 30 through the suction area 33. Thus, the air stream is circulated within the knitting machine and is isolated from the surrounding environment. Where several such machines are provided in a work room, this is important in preventing cross-contamination (e.g. of colored lint) between the machines.

The fan unit 19 is positioned at ground level for ease of maintenance, and the ducts 34 and 35 are of generally arched configuration to allow an operator all-round access to the knitting machine itself. The filter bag 36 is also disposed at or around ground level for ease of replacement and/or cleaning.

By using the cleaning system described above, lint can be effectively removed from the most sensitive lint generation points using a single fan unit, thereby avoiding the need for multiple fans and complicated slip ring assemblies and mounting bracketry. Moreover, the air flowing through the system is put to two important uses, namely cleaning both the knitting points and the yarn feed devices.

We claim:

1. A knitting machine in which yarn is knitted at knitting points and is fed to the knitting points by feed devices, the knitting machine comprising at least one suction duct disposed closely adjacent to the knitting points, air circulation means operative for drawing air continuously in through the suction duct and thereby creating a localized suction effect at the knitting points, a second duct means through which air is passed by the air circulation means and from which said air is emitted simultaneously and continuously towards all the yarn feed devices, and filter means through which the air passes in between being drawn in through the suction duct and being emitted from the second duct means, wherein said filter means and said second duct means fluidly communicate with the suction duct.

2. The knitting machine as claimed in claim 1, wherein the air is emitted from the second duct means towards the yarn feed devices in a downward direction.

3. The knitting machine as claimed in claim 1, wherein the air circulation means comprises a single fan unit which is connected to the suction duct by way of a third duct.

4. The knitting machine as claimed in claim 1, wherein the air circulation means comprises a centrifugal fan unit.

5. The knitting machine as claimed in claim 1, wherein said at least one suction duct comprises one of an annular and arcuate duct which extends across the knitting points.

6. The knitting machine as claimed in claim 1, wherein the air circulation means and the filter means are disposed remotely from the knitting machine.

7. The knitting machine as claimed in claim 6, wherein the air circulation means and the filter means are positioned proximate to ground level, and are connected to the suction duct by way of third duct means which is of arched configuration.

* * * * *

UNITED STATES PATENT AND TRADEMARK OFFICE

CERTIFICATE OF CORRECTION

PATENT NO. : 5,675,991

DATED : October 14, 1997

INVENTOR(S) : William Ewart Alan Shelton; Mark Alan Shelton

It is certified that error appears in the above-indentified patent and that said Letters Patent is hereby corrected as shown below:

On the Title Page, in the Foreign Application Priority Data Block, delete "932021.8" and insert --9320201.8--.

Signed and Sealed this

Third Day of March, 1998

Bruce Lehman

*Attest:*

BRUCE LEHMAN

*Attesting Officer*

*Commissioner of Patents and Trademarks*